US006131968A

United States Patent [19]

Bruce

[11] Patent Number: 6,131,968

[45] Date of Patent: Oct. 17, 2000

[54] LOCK SYSTEM FOR SHED

[76] Inventor: Terry W. Bruce, 9808 Joppa Rd., Vermilion, Ohio 44089

[21] Appl. No.: 09/340,695

[22] Filed: Jun. 29, 1999

[51] Int. Cl.[7] ..... E05C 19/18

[52] U.S. Cl. ..... 292/259 R; 292/292

[58] Field of Search ..... 292/145, 148, 292/150, 151, 259, 292, 295

[56] References Cited

U.S. PATENT DOCUMENTS

| | | | |
|---|---|---|---|
| 1,779,491 | 10/1930 | Rau | 292/259 |
| 2,373,783 | 4/1945 | Schlifer | 292/259 |
| 3,603,629 | 9/1971 | Windham | 292/145 |
| 3,769,821 | 11/1973 | Randel | 70/33 |
| 4,491,354 | 1/1985 | Williams | 292/148 |
| 4,669,767 | 6/1987 | Leto | 292/292 |
| 4,772,053 | 9/1988 | Oxley | 292/259 R |
| 4,815,774 | 3/1989 | Correnti | 292/145 |
| 4,823,570 | 4/1989 | Jurek | 70/129 |
| 5,080,354 | 1/1992 | McDougall | 292/145 |
| 5,165,741 | 11/1992 | Everett | 292/259 R |
| 5,232,254 | 8/1993 | Teaff | 292/259 R |
| 5,474,343 | 12/1995 | Ledbetter | 292/259 R |
| 5,605,364 | 2/1997 | Shelledy | 292/259 R |
| 5,669,640 | 9/1997 | Ryan | 292/259 R |
| 5,669,641 | 9/1997 | Jeansonne | 292/259 R |
| 5,772,266 | 6/1998 | Skiba | 292/259 R |

*Primary Examiner*—Lynne H. Browne
*Assistant Examiner*—John B Walsh
*Attorney, Agent, or Firm*—Richard C. Litman

[57] ABSTRACT

A lock system for a shed having a crossbar which is inserted through an opening in a side wall of the shed through guides mounted on the rear of the front wall and the doors of the shed and secured by a lock. The crossbar is a solid, elongated rod with a first lock plate projecting from one end of the rod. The guides are made from a plurality of sections of a hollow tube mounted on the rear of the front walls and door of the shed with the bores of each section aligned horizontally and in registry, so that the guides extend for substantially the length of the rod. A stationary bracket is mounted to the interior of the shed with a second lock plate extending through the opening in the side wall of the shed. A base plate having an aperture defined therein is attached to the exterior of the side wall of the shed, the aperture being dimensioned to permit the rod and the first and second lock plates to extend through the aperture. The first and second lock plates have apertures defined therein which may be aligned in order to receive a lock securing the crossbar to the shed. The lock is preferably of the slide lock variety, having a channel or other means for clamping the first and second lock plates together and in which no lock bolt is exposed.

8 Claims, 7 Drawing Sheets

LOCK SYSTEM FOR SHED

BACKGROUND OF THE INVENTION

1. Field of the Invention

The present invention relates to security devices for storage facilities, and particularly to a lock system for a shed and other similar accessory structures.

2. Description of the Related Art

Storage sheds are well known accessory structures which have been found useful for both residential and business purposes. In a residential setting, sheds are commonly used to store lawn mowers and other lawn and garden equipment and machinery, as well as volatile liquids, such as gasoline, used in conjunction with such equipment. Sheds may also be used for the storage of portable grills and their flammable fuels, such as propane cylinders. Sheds have been used as an adjunct storage facility for storing a variety of business equipment, records, and other paraphernalia associated with the conduct of a business enterprise.

Sheds are commonly small structures, frequently mounted on temporary foundations, and are often single room structures made from wooden walls or from aluminum siding mounted on a wooden frame. Access to the structure is usually restricted to either a single door or through double doors installed in the front of the structure. Sheds are uninhabited, are outlying from a residence or main business structure, and typically not equipped with a security alarm. Primary reliance for security is generally placed in some form of lock system to secure the doors from unauthorized entry. Such lock systems vary in their degree of sophistication. Consequently, sheds are frequent targets for thieves and vandals.

One commonly used lock system is a simple hasp and padlock. However, in this system the padlock may be removed with a hack saw or bolt cutter, or the hasp may be removed with a screwdriver or torn loose with a pry bar.

Another commonly used lock system employs a bar mounted across the doors on the outside of the shed which may be secured with a lock. An improved version of this type of lock system is shown in U.S. Pat. No. 5,669,640, issued Sep. 23, 1997 to C. R. Ryan. The device in Ryan includes a bar mounted on a pair of lock posts and secured by a padlock, one end of the bar being shaped to conform to the pivoting bar of the padlock in order to prevent tampering with the padlock.

Other lock systems which illustrate a bar placed across the doors on the outside of an enclosure are disclosed in U.S. Pat. No. 4,491,354, issued Jan. 1, 1985 to L. D. Williams, and U.S. Pat. No. 4,772,053, issued Sep. 20, 1988 to R. C. Oxley. The Williams patent describes a crossbar which is partially disposed in a pair of mounting brackets which a hollow, rectangular tubes, the bar being secured by a hasp and padlock. Oxley teaches an L-shaped crossbar and two mounting plates which are perpendicular to each other, the bar being secured by a padlock at both ends of the crossbar, the crossbar pivoting on one mounting plate when the lock is removed from the opposite end of the crossbar.

The problem with lock systems in which the bar is mounted across the doors on the outside of the shed is that the bar is still exposed to vandals, who may cut the bar with a hack saw or who may insert a pry bar between the crossbar and the doors of the structure in order to gain enough leverage to pry the mounting brackets free from the walls or doors of the structure.

The present invention further deters attempted unauthorized entry into a shed or other structure by mounting a rod or crossbar across the doors of the shed on the interior of the shed. A number of patents describe lock systems which include a bar across the door on the inside of the structure, often applying pressure against the door so that access cannot be gained by kicking in the door of the structure, such as the devices shown in U.S. Pat. No. 5,165,741, issued Nov. 24, 1992 to J. D. Everett; U.S. Pat. No. 5,232,254, issued Aug. 3, 1993 to J. C. Teaff; U.S. Pat. No. 5,474,343, issued Dec. 12, 1995 to J. W. Ledbetter; U.S. Pat. No. 5,605,364, issued Feb. 25, 1997 to J. R. Shelledy; U.S. Pat. No. 5,669,641, issued Sep. 23, 1997 to J. R. Jeansonne; and U.S. Pat. No. 5,772,266, issued Jun. 30, 1998 to W. Skiba. These devices, however, are designed for inhabited structures and are put in place from the inside of the structure. They do not permit raising or removing the bar from the outside of the structure.

Consequently, none of the above inventions and patents, taken either singularly or in combination, is seen to describe the instant invention as claimed. Thus a lock system for a shed solving the aforementioned problems is desired.

SUMMARY OF THE INVENTION

A lock system for a shed having a crossbar which is inserted through an opening in a side wall of the shed through guides mounted on the rear of the front wall and the doors of the shed and secured by a lock. The crossbar is a solid, elongated rod with a first lock plate projecting from one end of the rod. The guides are made from a plurality of sections of a hollow tube mounted on the rear of the front walls and door of the shed with the bores of each section aligned horizontally and in registry, so that the guides extend for substantially the length of the rod. A stationary bracket is mounted to the interior of the shed with a second lock plate extending through the opening in the side wall of the shed. A base plate having an aperture defined therein is attached to the exterior of the side wall of the shed, the aperture being dimensioned to permit the rod and the first and second lock plates to extend through the aperture. The first and second lock plates have apertures defined therein which may be aligned in order to receive a lock securing the crossbar to the shed. The lock is preferably of the slide lock variety, having a channel or other means for clamping the first and second lock plates together and in which no lock bolt is exposed.

Accordingly, it is a principal object of the invention to provide a lock system for a shed having a crossbar extending across the doors of the shed.

It is another object of the invention to provide a lock system for a shed having a crossbar across the doors of the shed which is removably mounted on the interior of the shed in order to preclude access to the crossbar or crossbar mounting hardware by vandals or thieves.

It is a further object of the invention to provide a lock system for a shed having a crossbar mounted across the doors of the enclosure on the interior of the shed in which the crossbar may be positioned to latch and unlatch the doors of the enclosure from the exterior of the shed.

Still another object of the invention is to provide a lock system for a shed in which neither a crossbar nor a lock bolt are exposed to possible tampering by thieves or vandals.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
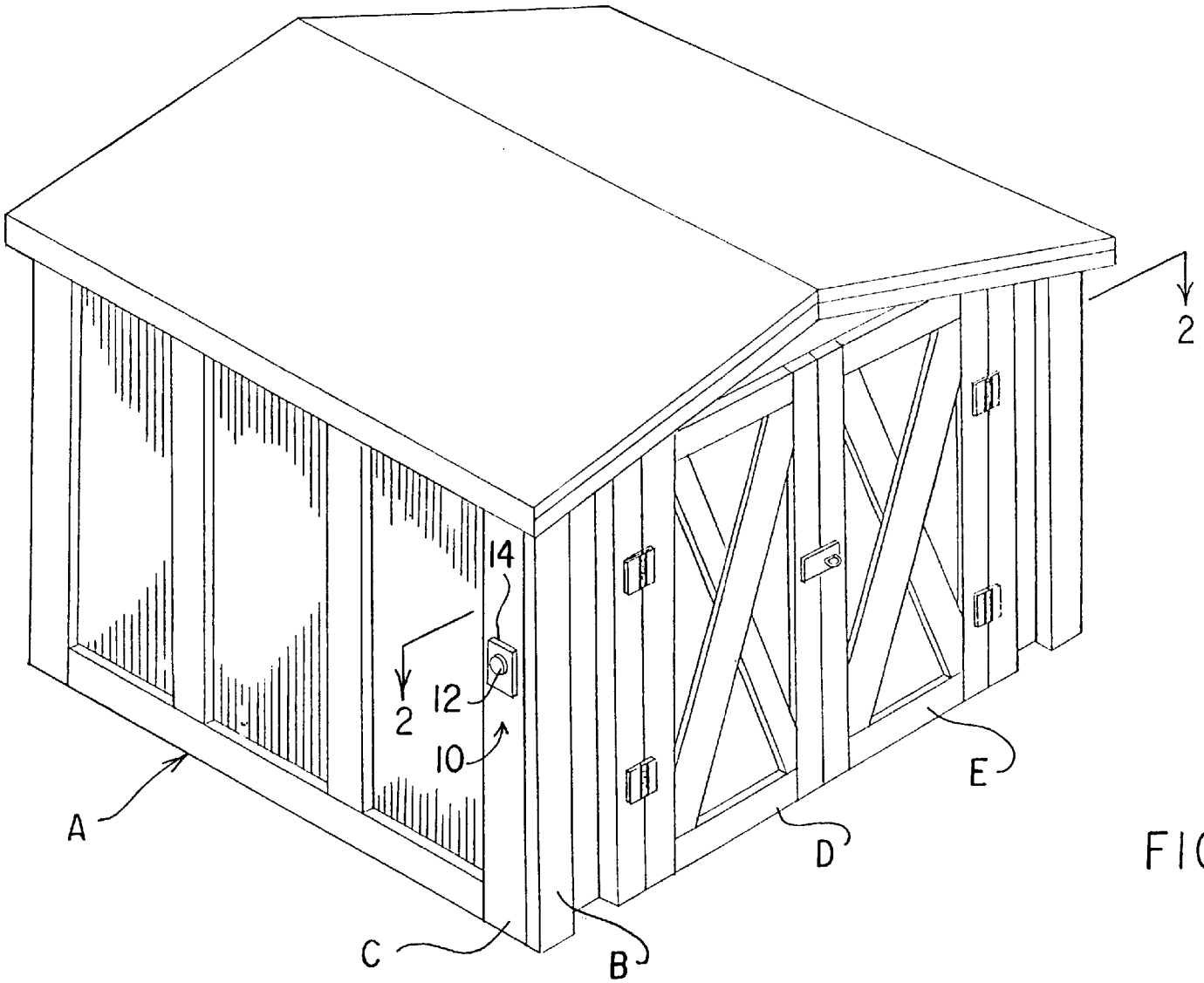
FIG. 1 is an environmental, perspective view of a lock system for a shed according to the present invention.
Figure 2:
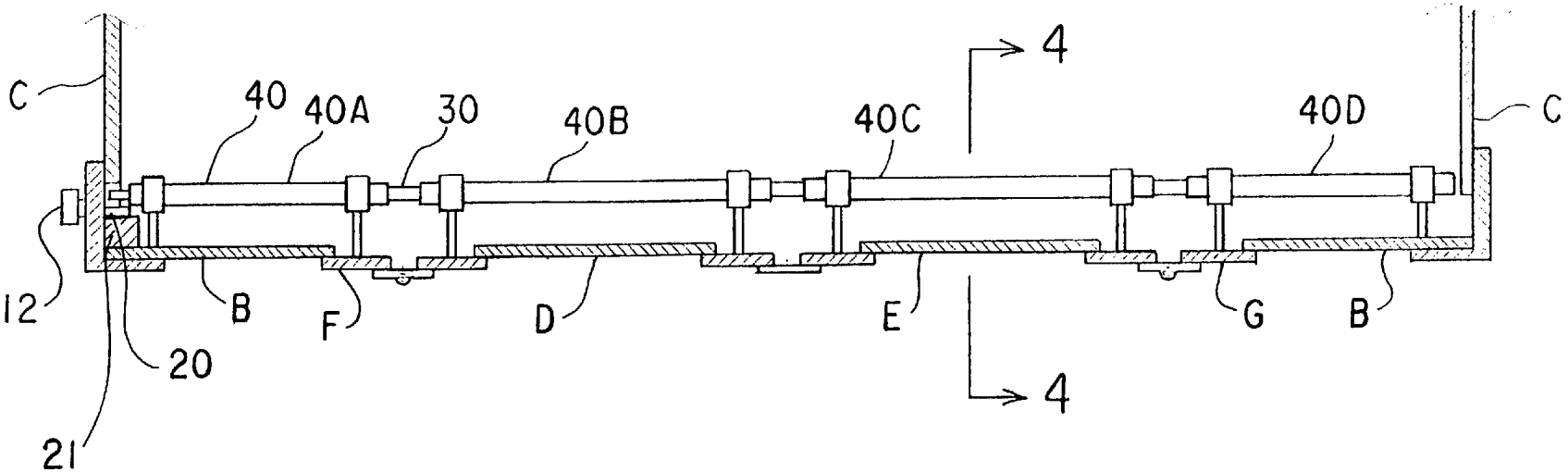
FIG. 2 is a fragmented section view drawn along lines 2—2 of FIG. 1.

The present invention is a lock system for a shed, designated generally as 10 in the drawings. The lock system 10 is shown in FIGS. 1 and 2 in use with a shed A having a front wall B, a side wall C, a first door D and a second door E. As shown in FIG. 1, in use substantially the only parts of the lock system 10 visible from the exterior of the shed A are the lock 12 itself and a base plate 14 on a side wall C of the shed A. With reference to FIG. 2, it will be seen that the lock system 10 also includes a stationary bracket 20, a crossbar 30, and guides 40.

Figure 3:
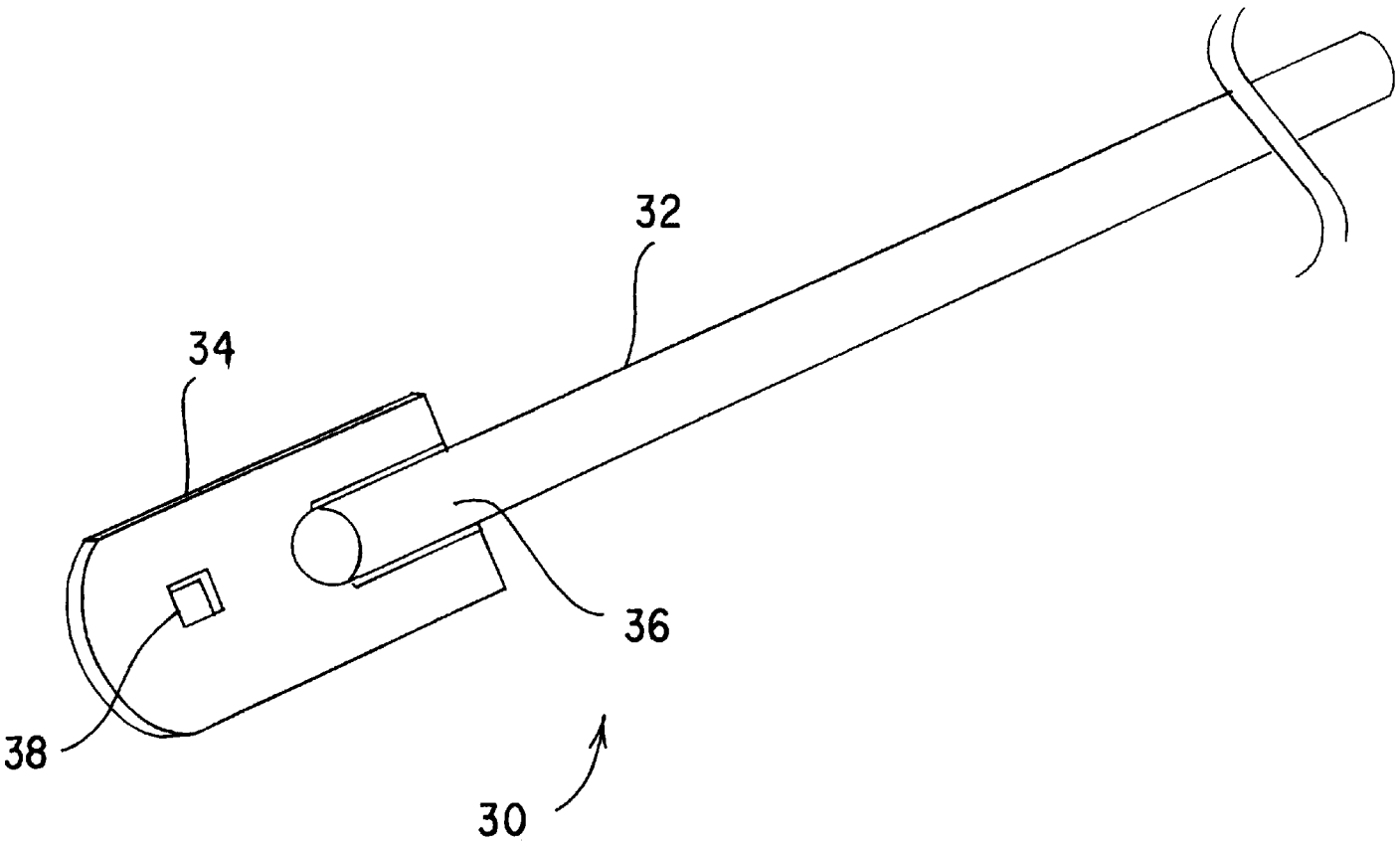
FIG. 3 is a perspective view of the crossbar of a lock system for a shed according to the present invention.
Figure 4:
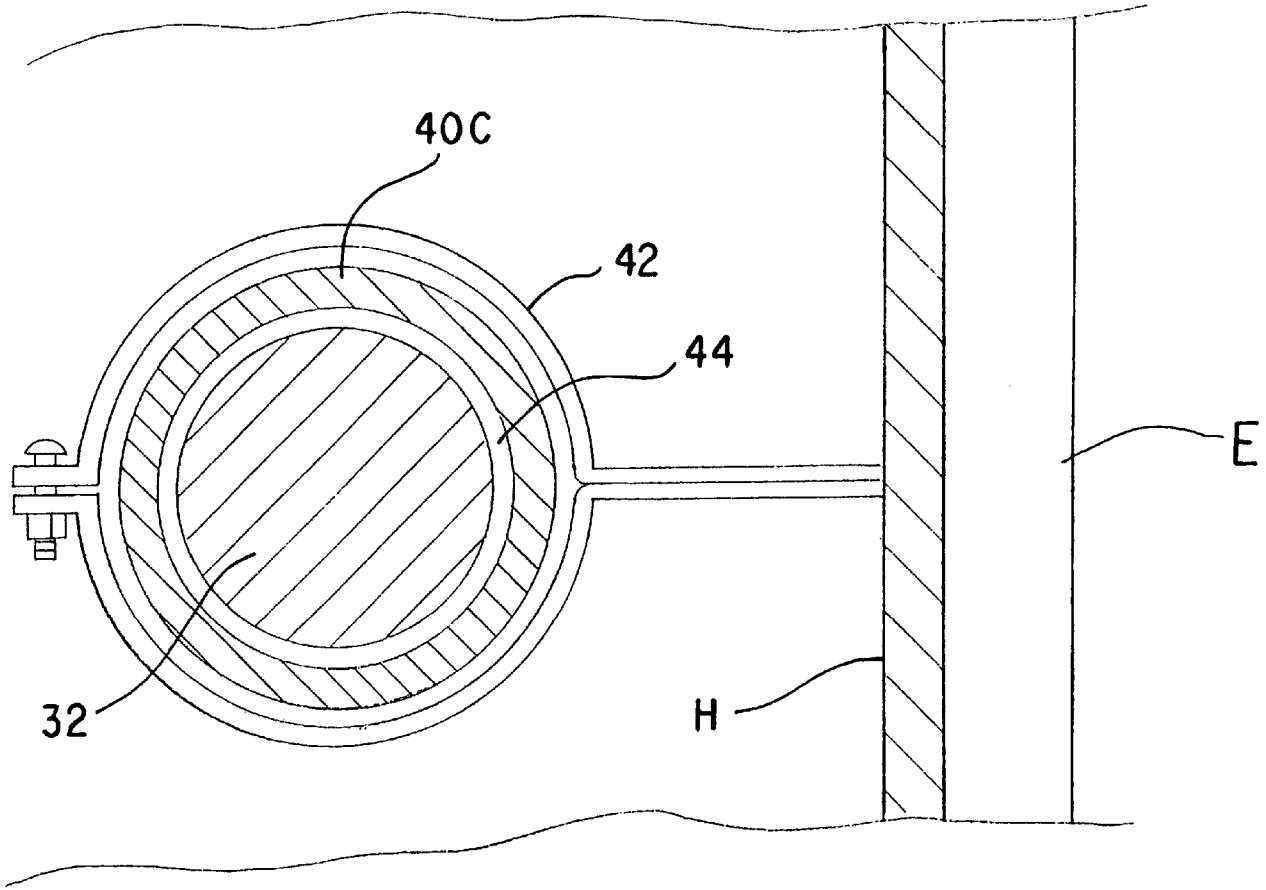
FIG. 4 is a section view along the lines 4—4 of FIG. 2.

The crossbar 30 is shown more particularly in FIG. 3. The crossbar 30 includes a solid, elongated rod 32 and a substantially flat first lock plate 34 projecting from one end 36 of the rod 32. The first lock plate 34 is fixedly attached to the rod 32, as by welding, and includes an aperture 38 defined therein in the portion of the plate 34 projecting from the rod 32. As shown in FIG. 4, the rod 32 is preferably circular in cross section. The rod 32 and the lock plate 34 are preferably made from steel. Although the rod 32 is preferably solid, it may be hollow. The length of the rod is slightly less than the width of the front wall B of the shed A measured from one side wall C to the opposing side wall C.

The guides 40 are made from a plurality of sections of hollow tubing having the same diameter. The guides 40 may be made, for example, from polyvinyl chloride (PVC) tubing, such as electrical conduit, having an inside diameter slightly greater than the outside diameter of the rod 32 so that the rod 32 may be slidably disposed in the guides 40. The guides 40 shown in FIG. 2 consist of conduit cut into four separate sections, including a first section 40A, disposed in the interior of the shed A behind a portion of the front wall B between a side wall C and the door jamb F of the first door D, a second section 40B disposed behind the first door D, a third section 40C disposed behind the second door E, and a fourth section 40D disposed behind a section of the front wall between the door jamb G supporting the second door E and the opposing side wall C, so that the guides 40 extend horizontally across substantially the width of the shed A, but permit the doors D and E to open freely when the crossbar 30 is not disposed within the guides 40. The guides 40 are mounted on the rear surface H of the front wall B and doors D and E by clamps 42, U-brackets, or any other appropriate hardware so that the sections 40A, 40B, 40C, and 40D are disposed horizontally with the bores 44 defined in each section aligned and in registry.

Figure 5:
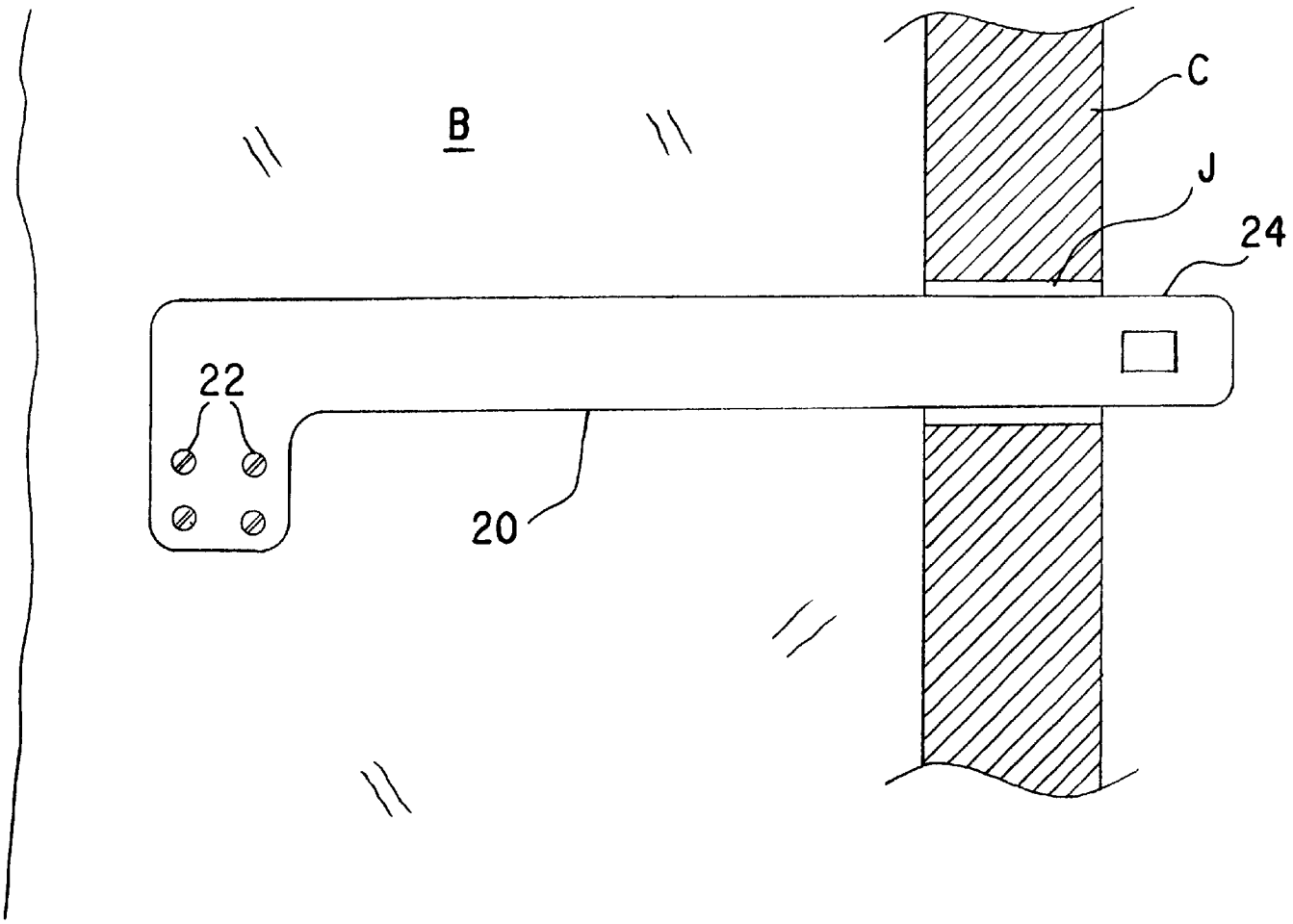
FIG. 5 is an environmental, side view of the stationary bracket of a lock system for a shed according to the present invention.

The stationary bracket 20 may be seen more clearly in FIG. 5. The stationary bracket is a substantially flat, dogleg (or L-shaped) steel plate which is affixed to the rear surface H of the front wall B, either directly or by means of a mounting block 21 affixed to the front wall B, as shown in FIG. 2. The stationary bracket 20 may be attached to the front wall B by a plurality of wood screws 22, rivets, or any other conventional fastening means. A portion of the stationary bracket 20 extends through a hole J defined in the side wall C and defines a second lock plate 24. The second lock plate 24 has an aperture 26 defined therein having the same shape and dimensions as the aperture 38 defined in the first lock plate 34.

Figure 6:
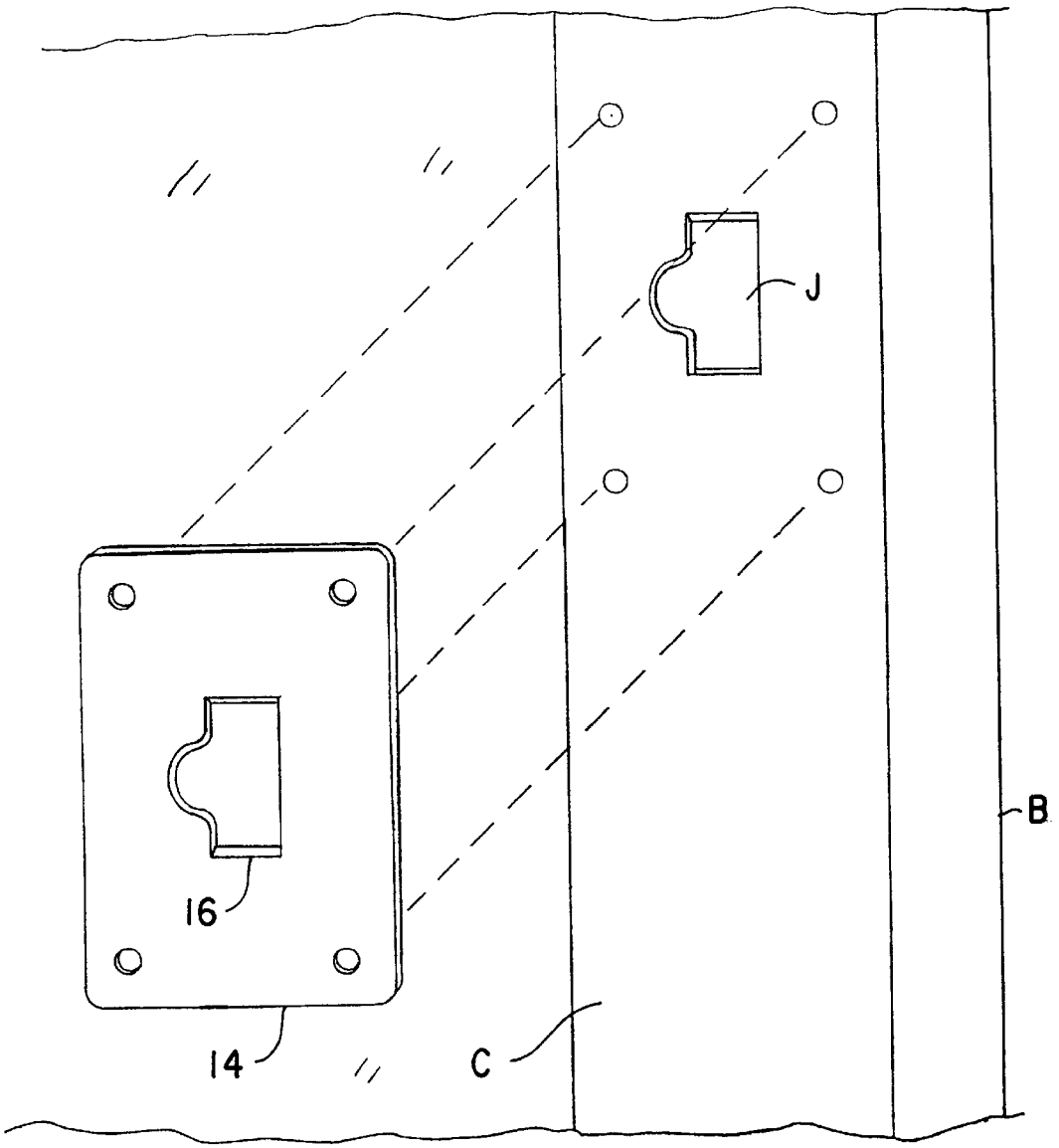
FIG. 6 is a perspective view of the base plate of a lock system for a shed according to the present invention.

The base plate 14, seen more clearly in FIG. 6, is a substantially flat steel plate which is affixed to a side wall C of the shed A on the exterior of the shed A. The base plate 14 has an aperture 16 defined therein having substantially the same shape and dimensions as the hole J defined in the side wall C, and which is adapted for extending the rod 32, first lock plate 34 and second lock plate 24 through the aperture 16 and hole J. The base plate 14 may be attached to the side wall C by any conventional fastening means, such as wood screws, rivets, carriage bolts, etc.

The lock 12 preferably of the slide lock variety, such as the Lock Device described in U.S. Pat. No. 3,769,821, issued Nov. 6, 1973 to M. A. Randel, which is hereby incorporated by reference in its entirety. The lock described in Randel is essentially a disk shaped body with a channel defined in one surface for receiving a pair of abutting flanges and having a bore defined through one side of the disk transverse to the channel with a lock cylinder, lock bolt, and latch slidably disposed in the bore. Consequently, the lock bolt is not exposed, only the disk shaped body and cylinder key hole being visible during use. Other preferred locks include the American Lock® Sliding Lock Series 2000 locks, offered by the American Lock Company, Crete, Ill. A conventional padlock may be used, but is not preferred, as the lock bolt is exposed and as the padlock does not clamp the two lock plates 24 and 34 together.

Figure 7:
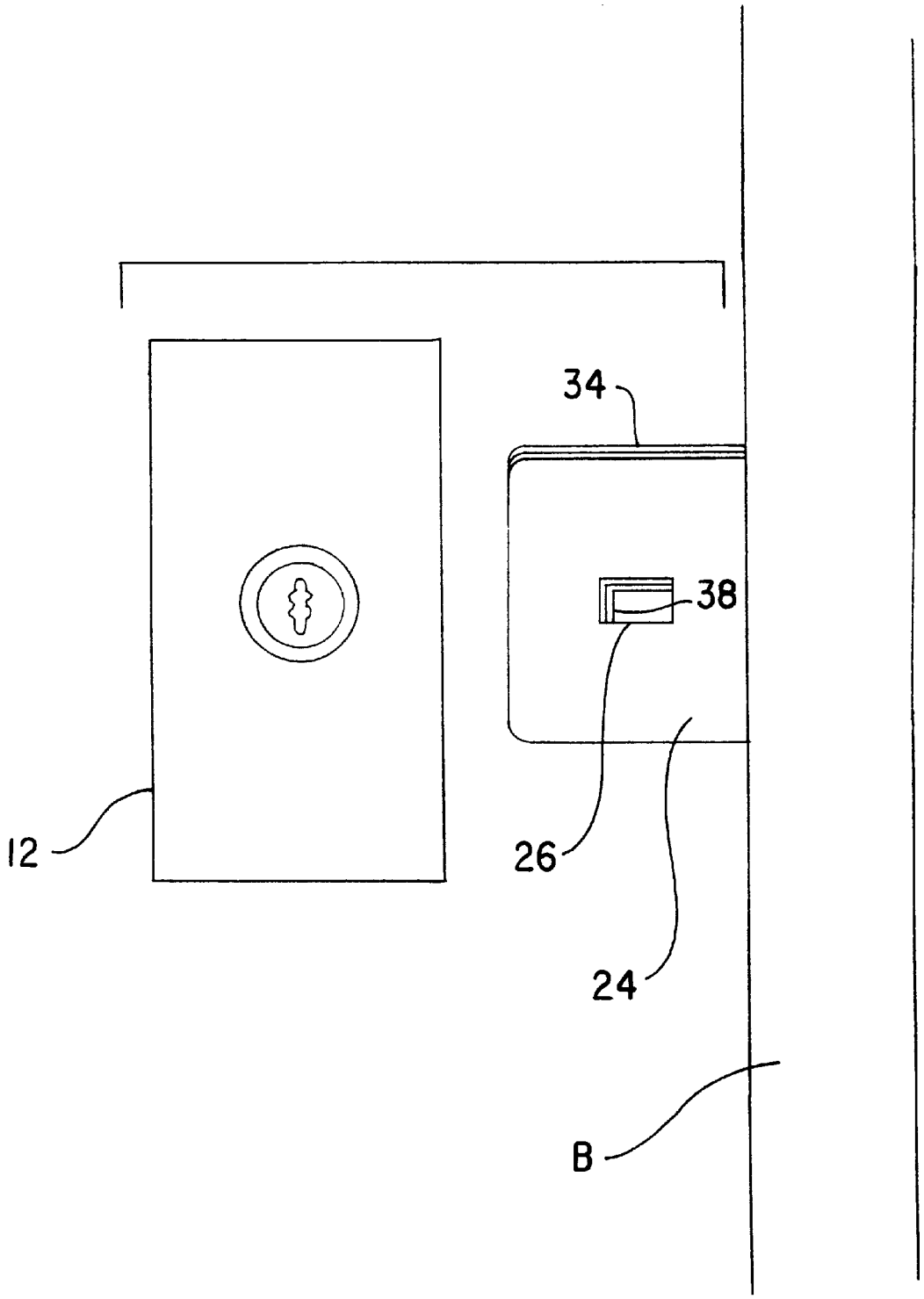
FIG. 7 is an exploded, front view showing the lock of a lock system for a shed according to the present invention.

In use, the stationary bracket 20 and base plate 14 are fixedly attached to the shed A with the second lock plate 24 extending through the aperture 16 and the hole J defined in a side wall C of the shed A. The guides 40 are likewise fixedly attached to the rear surface of the front wall B and doors D and E, with their bores 44 aligned horizontally and in registry with each other and with the aperture 16 and hole J. The crossbar 30 is inserted through the aperture 16 and the aligned bores 44 of the guides 40 in rear of the front wall B and doors D and E, the aperture 38 in the first lock plate 34 being aligned with the aperture 26 in the second lock plate 24, as shown in FIG. 7. In the preferred embodiment, only about one inch of the first 34 and second 24 lock plates extend to the exterior of the shed A. The lock 12 is then placed on the lock plates 24 and 34, the lock cylinder being extended to insert the lock bolt and latch between the aligned apertures 26 and 38, and the key turned to latch the lock plates together.

It will be seen that the lock system 10 of the present invention provides a secure, economical means of protecting goods stored in either residential or commercial sheds which leaves few parts of the lock mechanism exposed to thieves or vandals.

Representative dimensions of the crossbar 30 in a preferred embodiment of the invention include a rod 32 eight feet in length by ½" diameter and a first lock plate four inches long by 1¼" wide by 3/16" thick. Representative dimensions of the guides 40 include a PVC conduit approximate eight feet in length with an outside diameter of ⅞" and an inside diameter of ⅝", the conduit being cut into four sections 40A through 40D of appropriate length.

It is to be understood that the present invention is not limited to the embodiments described above, but encompasses any and all embodiments within the scope of the following claims. In particular, it will be noted that although the rod 32 and guides 40 with circular cross section, the rod 32 and guides 40 may be rectangular or square in cross section. It will further be noted that the apertures 38 and 26 defined in the first 34 and second 24 lock plates, respectively, are shown having a rectangular shape to accommodate the latch of the lock shown in the Randel patent, but may have any other shape, including circular, in order to accommodate the latch or lock bolt of any other lock 12 which may be desired. Further, although the guides 40 are shown as having four sections 40A–40D in order to accommodate a shed A with two doors D and E, the number of sections of guides 40 may vary according to the number of doors on the shed A, with, for example, three sections being appropriate for a shed A with only one door.

I claim:

1. A lock system for locking a door of a shed, the shed having an interior and an exterior, at least one door disposed in a front wall of the shed, a first side wall having a hole defined therein, and a second, opposing side wall, the lock system comprising:

a) a base plate having a first aperture defined therein, the base plate attachable to the first side wall of the shed with the first aperture aligned with the hole defined in the first side wall;

b) a stationary bracket attachable to a rear surface of the front wall of the shed, a portion of the stationary bracket projecting through the first aperture to the exterior of the shed in order to define a first, substantially flat lock plate having a second aperture defined therein;

c) a plurality of guide sections mountable on the rear surface and door of the shed, each guide section being hollow and having a bore defined therein, the guide sections being aligned horizontally with the bores in registry with the first aperture defined in said base plate;

d) a crossbar, the crossbar being an elongated rod having a second substantially flat lock plate fixedly attached to an end of the rod, the second lock plate having a third aperture defined therein, the rod having an outside perimeter slightly smaller than the inside perimeter of said guide sections, the crossbar being slidably inserted into said plurality of guide sections so that the crossbar extends across substantially the entire width of the front wall and at least one door of the shed and so that said second and third apertures are in registry when the lock system is in a locked position; and e) a lock attached to said first lock plate and said second lock plate for releasably latching said first lock plate and said second lock plate together parallel and in abutting contact when the lock system is in a locked position, the lock having a cylinder which extends through the second aperture and the third aperture when said lock is in the locked position in order to clamp said first lock plate and said second lock plate together.

2. The lock system for a shed according to claim 1, wherein said rod and said guide sections are circular in cross section.

3. The lock system for a shed according to claim 1, wherein said lock has a body which slides over said first lock plate and said second lock plate, clamping said lock plates together so that the said lock and said base plate are the only elements of said lock system visible from the exterior of the shed when said lock system is in a locked position.

4. The lock system for a shed according to claim 1, wherein said stationary bracket is a substantially flat steel plate affixed to the rear surface of the front wall of the shed.

5. The lock system for a shed according to claim 1, wherein said crossbar is made from steel.

6. The lock system for a shed according to claim 1, wherein said plurality of guide sections are made from polyvinyl chloride tubing.

7. The lock system for a shed according to claim 1, wherein said second aperture and said third aperture are rectangular in shape, having substantially the same length and width.

8. The lock system for a shed according to claim 1, wherein said second aperture and said third aperture are circular in shape, having the same diameter.

* * * * *